US007325502B2

(12) United States Patent
König et al.

(10) Patent No.: US 7,325,502 B2
(45) Date of Patent: Feb. 5, 2008

(54) METHOD AND DEVICE FOR CONTROLLING THE MOVEMENT OF A NEEDLE IN A SEWING MACHINE

(75) Inventors: Michael König, Constance (DE); Gérard Durville, Gipf-Oberfrick (CH); Wolfgang Zesch, Zürich (CH)

(73) Assignee: Fritz Gegauf Aktiengesellschaft Bernina-Nahmaschinenfabrik, Steckborn (CH)

( * ) Notice: Subject to any disclaimer, the term of this patent is extended or adjusted under 35 U.S.C. 154(b) by 0 days.

(21) Appl. No.: 11/441,867

(22) Filed: May 26, 2006

(65) Prior Publication Data

US 2006/0213415 A1 Sep. 28, 2006

Related U.S. Application Data

(63) Continuation-in-part of application No. PCT/CH2004/000065, filed on Feb. 5, 2004.

(30) Foreign Application Priority Data

Dec. 15, 2003 (CH) ..... 2140/03

(51) Int. Cl.
*D05B 1/00* (2006.01)

(52) U.S. Cl. ..... 112/475.02; 112/272; 112/470.03; 112/475.01

(58) Field of Classification Search ..... 112/102.5, 112/117, 272, 315, 470.03, 475.01, 475.02; 700/130, 131, 132, 136
See application file for complete search history.

(56) References Cited

U.S. PATENT DOCUMENTS 3,980,032 A * 9/1976 Kleinschmidt et al. ..... 112/313
4,342,273 A * 8/1982 Petzold ..... 112/272
4,398,348 A * 8/1983 Bergvall et al. ..... 33/735
4,423,691 A * 1/1984 Schwaab ..... 112/272
4,498,404 A * 2/1985 Sadeh ..... 112/470.04
4,548,143 A * 10/1985 Martell et al. ..... 112/470.03
4,658,741 A * 4/1987 Jehle et al. ..... 112/470.02
4,784,071 A * 11/1988 Sadeh et al. ..... 112/470.07
4,848,256 A * 7/1989 Ohchi ..... 112/235
4,860,675 A * 8/1989 Brower et al. ..... 112/119
5,271,345 A * 12/1993 Matschulat et al. .... 112/470.07
6,263,815 B1 * 7/2001 Furudate ..... 112/475.02
6,450,110 B1 * 9/2002 Bruhl et al. ..... 112/470.01
6,871,606 B2 * 3/2005 Schweizer ..... 112/475.02
6,883,446 B2 * 4/2005 Koerner ..... 112/272
6,959,657 B1 * 11/2005 Duval ..... 112/272

(Continued)

FOREIGN PATENT DOCUMENTS

DE 198 50 742 5/2001

(Continued)

*Primary Examiner*—Gary L. Welch
*Assistant Examiner*—Nathan E Durham
(74) *Attorney, Agent, or Firm*—Volpe and Koenig, PC

(57) ABSTRACT

A method and device for controlling movement of the needle in a sewing machine (1) based on a detection device (27), which detects the movements of the visible surface of the manually displaceable article to be sewn (3) is provided. The stitch formation of the sewing machine (1) is controlled by detected changes in positions of the article to be sewn (3) in connection with a predetermined stitch length. The detection device (27) can be integrated into a sewing foot (23) entirely or partially.

17 Claims, 6 Drawing Sheets

U.S. PATENT DOCUMENTS

| | | | | |
|---|---|---|---|---|
| 2001/0050036 | A1* | 12/2001 | Ebata et al. | 112/102.5 |
| 2003/0084831 | A1* | 5/2003 | Durville | 112/102.5 |
| 2003/0131773 | A1* | 7/2003 | Schweizer | 112/102.5 |
| 2005/0016428 | A1* | 1/2005 | Koerner | 112/117 |

FOREIGN PATENT DOCUMENTS

| | | |
|---|---|---|
| EP | 0 360 398 | 3/1990 |
| GB | 2 059 636 | 4/1981 |

* cited by examiner

METHOD AND DEVICE FOR CONTROLLING THE MOVEMENT OF A NEEDLE IN A SEWING MACHINE

CROSS REFERENCE TO RELATED APPLICATIONS

This application is a continuation-in-part of PCT/CH2004/000065, which was filed on Feb. 5, 2004, which claims the benefit of priority to Swiss Application No. 2140/03, filed Dec. 15, 2003, which are incorporated herein by reference as if fully set forth.

FIELD OF THE INVENTION

The invention is directed to a method and a device for controlling the movement of the needle in a sewing machine as well as a sewing foot for performing the method and an adapter according to the invention.

BACKGROUND

Commonly in sewing machines, after the execution of a stitch the article to be sewn is pushed forward to the subsequent stitching position via a transportation device. Frequently, transporters arranged in the area of the stitching plate are used for this purpose, which execute a flat-oval motion and hereby protrude through slits in the stitching plate in the driving phase and displace the article to be sewn in this manner. Several different methods are known to supervise the article to be sewn during such transportation processes. For example, sensors may be provided, which detect the edges of the article to be sewn and interrupt the sewing process in due time preventing any stitching from occurring outside the article to be sewn.

From DE 19850742, a device is known having a camera, which is used to determine the position of two adjacent stitching sites of the sewing needle on the article to be sewn. A reference device determines any deviations of the actual values from the predetermined target values for the position of these stitching sites and influences the material feed such that subsequent stitching sites deviate as little as possible from each desired target position.

When quilting, the article to be sewn, resting on the material support, is generally displaced manually into different directions, i.e. without the help of a material transportation device. Conventionally, the needle rod motion for executing the stitch is controlled by the operating person manually or via a treadle starter. The operating person himself/herself must adjust the sewing speed such that the respective speed of the material feed is adjusted such that the individual sewing stitches are executed at even distances in reference to one another. However, a method is already known, according to which a sensor arranged below the material support detects relative movements of the sewing machine and/or an object, immobile in reference to the sewing machine, to the material layer directly resting on the material support and/or stretched in a frame, controlling the sewing needle drive such that the distance between the individual stitches remains as constant as possible.

Generally the article to be sewn comprises several layers of material laying on top of one another and/or an application attached to a material layer. When displacing such a material stack comprising two or more material layers the position of the individual layers in reference to one another may change due to slippage. The extent of the slippage depends on the nature of the individual material layers, thus on the materials and their thickness, for example. Also, the number of individual layers is influential.

When determining the feed of the material and/or the article to be sewn from below only the movement of the lowermost material layer is registered. Due to slippage the uppermost layer can be displaced in reference to the layer detected by the sensor, which is the visual side after the sewing and/or quilting process. In the uppermost, visible material layer therefore the individual stitching positions can deviate from the desired target position. The limited spatial conditions in the area of the stitching plate below the material support oppose an optimum embodiment of the sensors for determining the movement of the article to be sewn. Unduly high faults can occur in detection sites at a great distance from the stitching site of the sewing needle. When the detection of the movement of the article to be sewn is to occur as close as possible to the stitching site of the sewing needle, this may prohibit the simultaneous presence of a transporter in this area.

Furthermore, the sharpness of conventional optical detection devices for detecting the movement of article to be sewn is extremely low. Therefore, in order to flawlessly detect the article to be sewn, means have to be provided, by which the article to be sewn can be held inside the limited range of sharpness of the detection device.

SUMMARY

The object of the present invention is to provide a method and a device for controlling the movement of the needle in a sewing machine, in which the movements of the article to be sewn, resting on a material support, in reference to the sewing machine are detected, and in which the movement of the sewing needle can be controlled depending on the relative movements.

This objective is attained by a device and a method according to the invention, by a sewing foot according to the invention, and by an adapter according to the invention.

In the method according to the invention and the device according to the invention the material surface relevant for the quality of the sewing and/or quilting process and/or their movements or relative movements parallel to the material support can be detected. As a result thereof, the deviation of the distance of neighboring stitches and/or the position of individual stitches from a selected or adjustable target distance and/or selected or adjustable target positions is minimal. The detection of the relative movement of the article to be sewn and/or any arbitrary immobile object in reference to the article to be sewn and the sewing machine or an arbitrary non-mobile object in reference to the sewing machine includes all possible embodiments with a mobile article to be sewn and/or a mobile sewing machine. The article to be sewn can be stretched into a frame or be freely mobile.

In a preferred embodiment of the invention an optical detection device is provided, in which an image section of the material surface is detected in the area of the sewing needle and which is imaged on an image sensor via an optic. The detection area and/or the image field detected is large enough that individual structural features of the article to be sewn can be detected several times within the detection range even at relatively high speeds or accelerations. The optic of the detection device has a sufficiently great depth of field so that the position or location and/or the movement of the article to be sewn can be detected reliably, independent from its thickness and the number of material layers.

In a particularly advantageous embodiment of the invention the detection device is at least partially integrated in the sewing foot. In this manner, the article to be sewn can be controlled in the proximity of the stitching site, by which faults due to different movements of the article to be sewn at the stitching site and the detection site can be kept to a minimum. During quilting, the sewing foot performs a jumping movement between two stitches. Although the detection optic also performs this jumping movement a reliable detection of the article to be sewn is ensured because the sharpness of the optic is at least appropriate to the lifting and jumping movement. Furthermore, lighting for the material surface is provided in the detection area, with a light beam impinging it at an optimum angle in reference to the material surface. Here, on the one hand, it is ensured that the material surface is imaged with high-contrast on the image sensor and, on the other hand, that sufficient lighting of the detection area is ensured during lifting and lowering movements of the sewing foot. In a particularly advantageous embodiment of the invention, the light of the light source is guided to the material surface via a prism and is guided therefrom via the same prism to the image sensor. Due to the special embodiment of the prism the light source and the image sensor can be arranged at a very close proximity to one another. Additionally the space required for the detection device in the immediate proximity of the material surface and the sole of the sewing foot is very small so that during sewing and/or quilting the sewing foot is hardly or not at all considered a hindrance.

BRIEF DESCRIPTION OF THE DRAWINGS

Using the figures, in the following the invention is described in greater detail. Shown are.

DETAILED DESCRIPTION OF THE PREFERRED EMBODIMENTS

Figure 1:
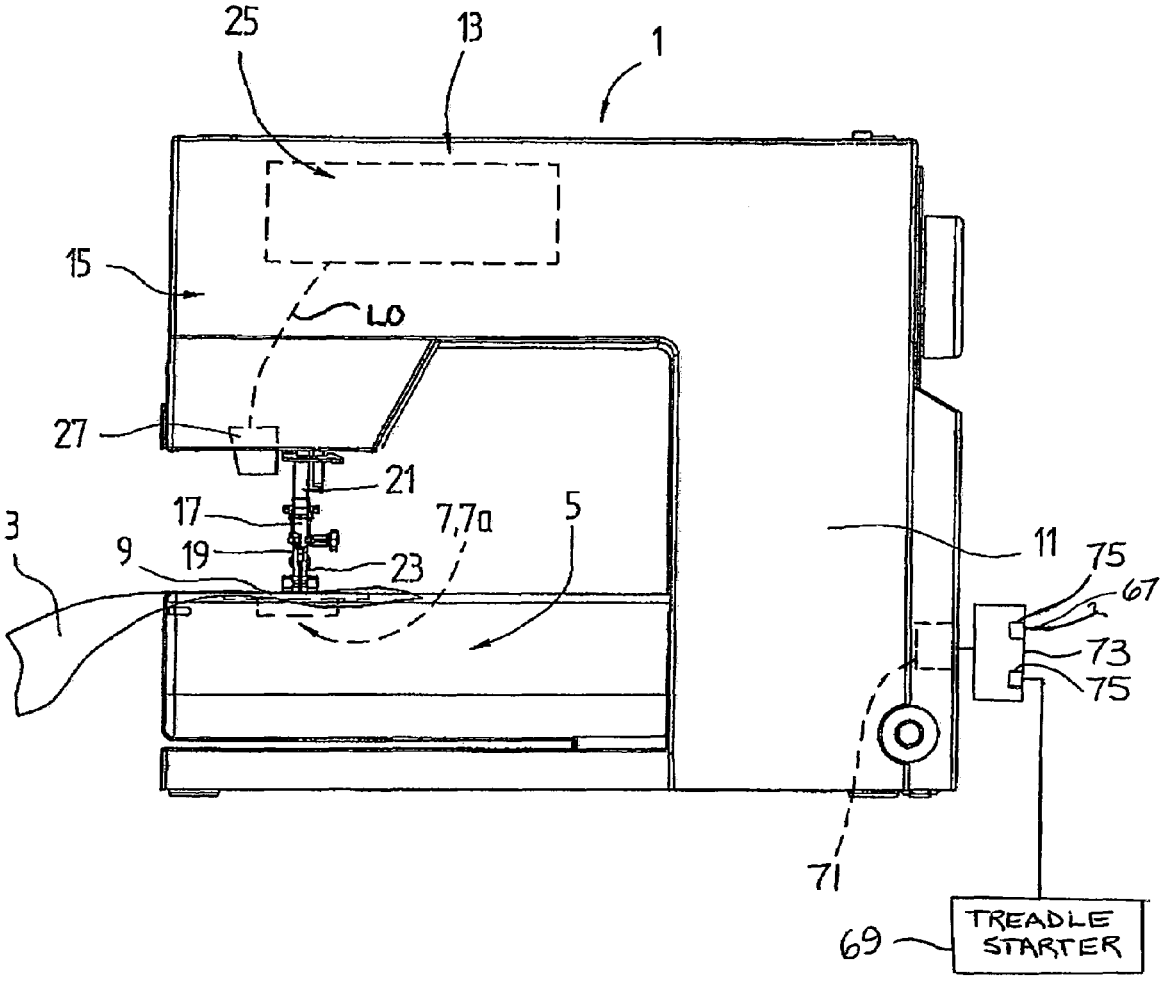
FIG. 1 is a diagram of the principle of a sewing machine with the detection device according to the invention.

FIG. 1 shows a schematic overview of a sewing machine 1 with a device for controlling and/or regulating the movement of the needle depending on the movement of the article to be sewn 3 which is resting on a material support and/or on the lower arm 5 and/or for detecting relative movements between the article to be sewn 3 and the sewing machine 1. Preferably the sewing machine 1 comprises a transportation device 7, e.g. a conventional transporter 7*a* with rail-like catchers (not shown), which perform an oblong-oval circular motion for feeding the material and/or the article to be sewn 3 by periodically protruding through the slits in a stitching plate 9. The transportation device 7 is adjustable and/or can be deactivated such that during sewing or quilting with a hands-free feed, no automatic material transport occurs. Alternatively the sewing machine 1 can also be made without a transportation device 7 for any automatic material transport.

Figure 2:
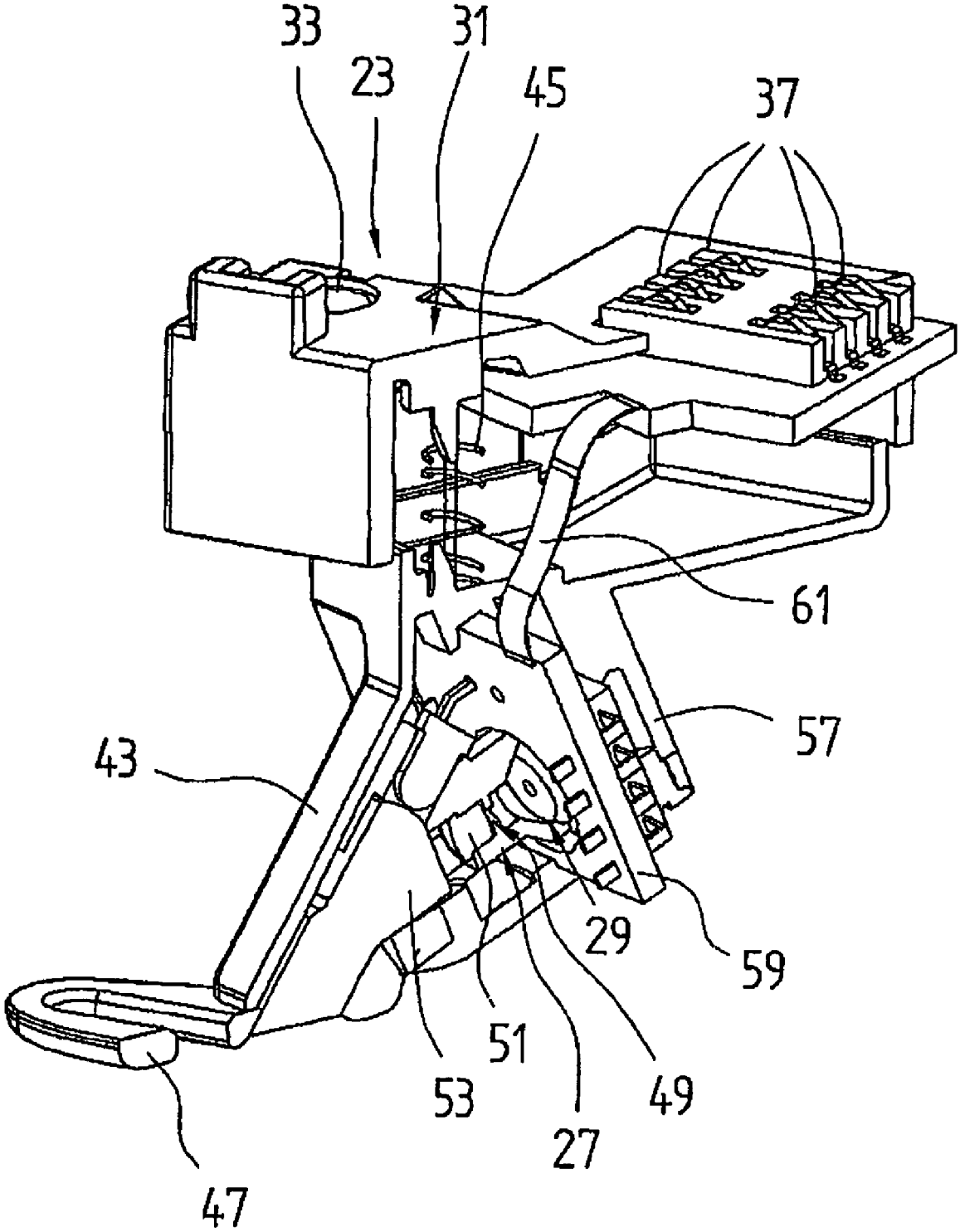
FIG. 2 is a partial cross-sectional view of a sewing foot with an integrated detection device.

Further, the sewing machine 1 comprises a stand 11, which carries an upper arm 13 with a sewing machine head and/or a head part 15. The head part 15 is arranged above the stitching plate 9. At the bottom of the head part 15, a needle rod 17 for accepting a sewing needle 19 and a material pressure rod 21 for accepting a sewing foot 23 protrude from the head part 15. A machine control 25 is provided for controlling the sewing machine 1. A detection device 27, being effectively connected to the machine control 25, is provided and arranged on the sewing machine 1 such that the movements of the article to be sewn 3 resting on the material support and/or the movements of the material surface, which face the sewing needle 19, can be detected in reference to the sewing machine 1. Here, the term sewing machine 1 also includes objects, such as a sewing table or a holding device for the sewing machine 1, which is not mobile in reference to the sewing machine 1. In FIG. 1 the effective connection of the detection device 27 to the machine control 25 is shown schematically by a dashed line L0. The effective connection serves for a unilateral or bilateral communication or signal transfer between the detection device 27 and the control 25 as well as, if necessary, for the energy supply of the detection device 27. The effective connection can e.g., comprise electric guides and/or optical transmitters and receivers and/or a radio connection, e.g., based on Bluetooth technology. Furthermore, optical elements, such as lenses, mirrors, light conductors, or similar devices can be components of the effective connection of the detection device 27 to the machine control 25. The detection device 27 is arranged above the stitching plate 9 such that it can detect the material surface and/or its relative movement in the area of the stitching site of the sewing needle 19 into the article to be sewn 3. For this purpose the detection device 27 preferably comprises a camera and/or an image sensor 29 (FIG. 2). This image sensor 29 captures, in rapid intervals (e.g. with a repetition frequency of approximately 1500 Hz), a two-dimensional image of the sections of the material surface located in the detection area of the sensor. Good results can be achieved with an image sensor 29, such as one used in optical computer mice, for example. High resolution sensors from laser mice are particularly advantageous. When displacing the article to be sewn 3 resting on the material support, image processing electronics integrated in the image sensor 29 or subsequent thereto can determine information, e.g., by the change of positions of structural features of the detected image section, concerning the direction and/or the extent and/or the speed and/or the acceleration of the displacement and/or the change in position of the article to be sewn 3 or equivalent or similar values.

The detection range of the image sensor 29 can include, depending on the embodiment and arrangement of the detection device 27, the stitching site of the sewing needle 19 in the article to be sewn 3 or can be adjacent to or spaced away in reference to the stitching site, for example in the area of the sole of the sewing foot 23. The detection area can be embodied elliptically or circularly, for example, and comprise an area of approximately 50 $mm^2$ or approximately 100 $mm^2$, for example. Preferably the detection area is located near the stitching site of the sewing needle 19. The center of a circular detection area can be located at a distance of approximately 5 mm or 10 mm or 15 mm from the stitching site of the sewing needle 19, for example. In this manner, it is achieved that the deviation of the determined movement information from the actual values of the relative movement of the article to be sewn 3 is minimal at the stitching site of the sewing needle 19. In particular the influence of the rotational movement around a rotary axis (not shown) extending through the sewing needle 19 is minimal. Additionally, the sewing foot 23 prevents the article to be sewn 3 to essentially be lifted off the material support in the area of the stitching site. The detection device 27 is embodied such that the detection of the article to be sewn 3 is largely independent from the thickness of the article to be sewn 3. In particular a display optic with optical elements, such as lenses and shutters, can be allocated to the image sensor 29, which result in a relatively high resolution of, for example, 3 mm or 5 mm or two thirds the distance between the stitching plate 9 and the bottom of the head part 15 for the article to be sewn 3 that is to be detected. The detection device 27 can be arranged entirely or partially a) in the lower section of the head part 15, or
b) between the head part 15 and the stitching plate 9, or
c) integrated in and/or held at a sewing foot 23, which is preferably interchangeable.

In order to better understand the invention, in the following a first device for controlling and/or influencing the movement of the needle is described in greater detail, in which the detection device 27 is integrated in the sewing foot 23 in its entirety or partially and/or held by it.

Figure 3A:
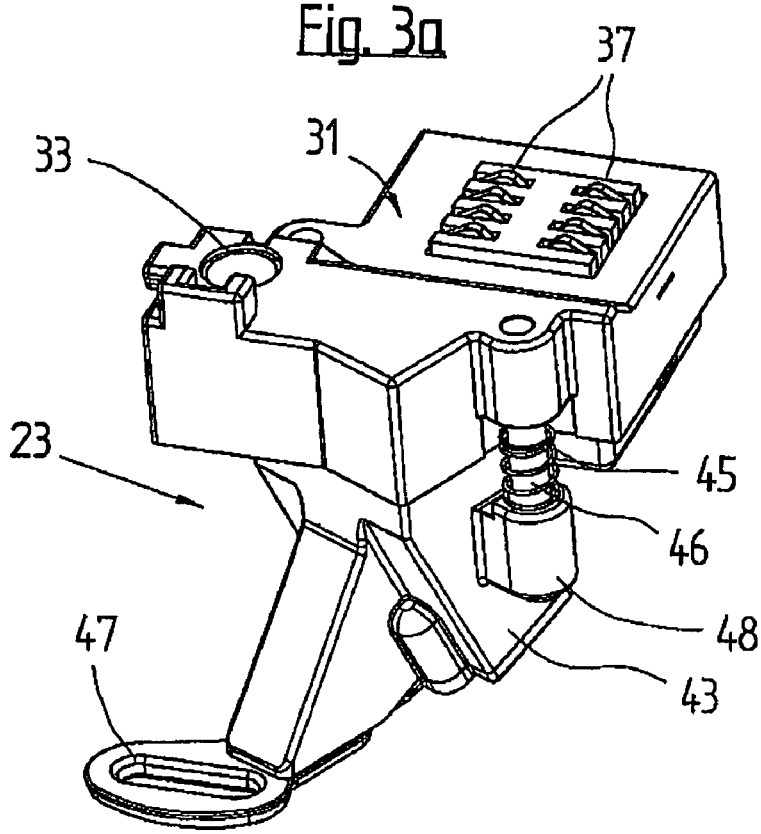
FIG. 3*a* is a perspective view of the entire sewing foot according to FIG. 2.
Figure 3B:
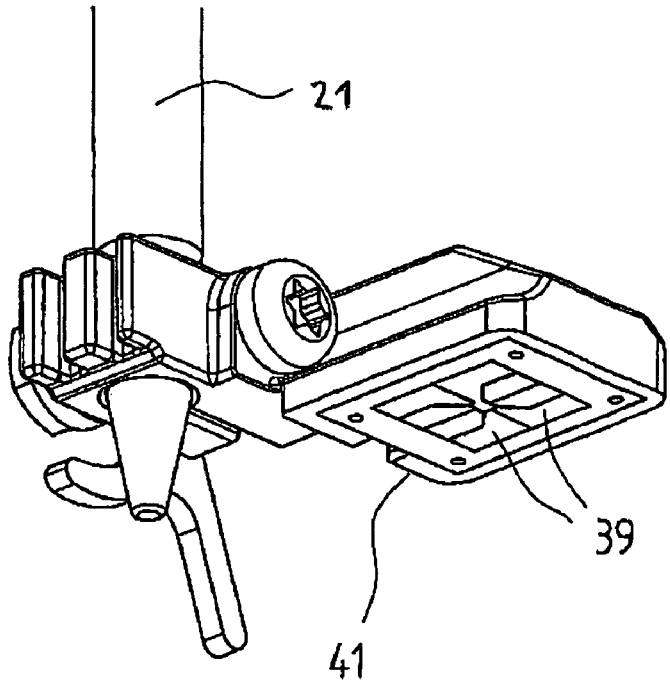
FIG. 3*b* is a view of the lower end of a material pressure rod with an adapter for connecting the sewing foot according to FIG. 3*a*.
Figure 4:
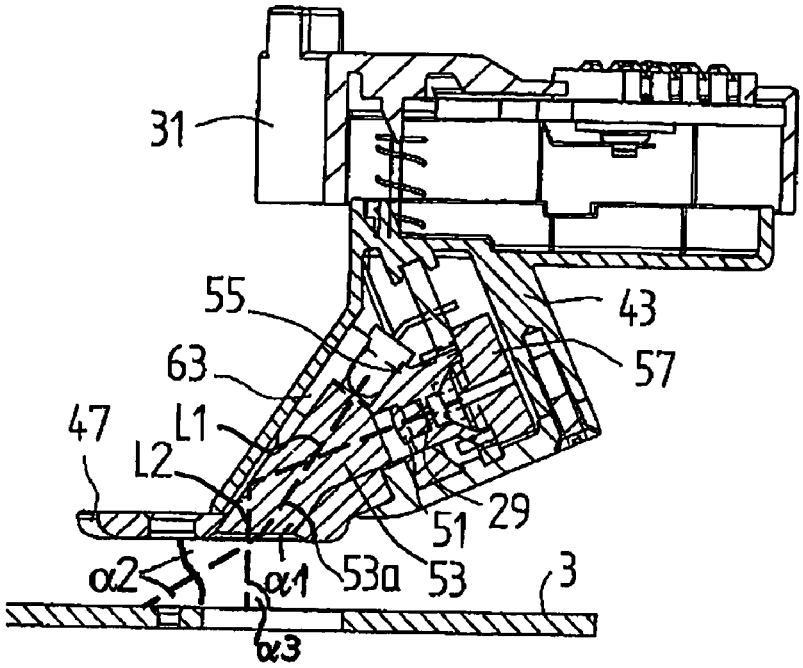
FIG. 4 is a cross-sectional side view of the sewing of the foot according to FIG. 2.

FIG. 2 shows a first embodiment of such a sewing foot 23, with it being in a partial cross-section. The sewing foot 23 comprises a shaft 31 with a round accepting opening 33 arranged on the top for mounting the sewing foot 23 to the lower end of the material pressure rod 21 (FIG. 3*b*). At the upper side of the shaft 31 contact elements 37 are provided, for example in the form of contact springs within a contact module. They contact complementary contact surfaces 39 of a contact circuit board 41 held in the lower region at the material pressure rod 21, when the sewing foot 23 is mounted to the material pressure rod 21. This electric connection is a component of an effective connection of the machine control 25 to the detection device 27. At the bottom of the shaft 31, an intermediate part 43 is mounted elastically or alternatively rigidly to the shaft 31. As is discernible in FIGS. 2 and 3*a*, between the shaft 31 and the intermediate part 32 one or more helical springs 45 can be provided, which press the intermediate part 43 against one and/or several stops 48 embodied at a part connected thereto, such as a guiding rod 46. If a counterforce develops when the sewing foot 23 is pressed onto the article to be sewn 3, the intermediate part 43 is displaced against the force of the helical springs 45. Here it is guided by the guiding rod 46 or other guiding elements. At the bottom end of the intermediate part 43, a quilting and/or sewing sole, sole 47 for short, is connected in an exchangeable or alternatively in a fixed manner to the intermediate part 43. In the example shown in FIG. 2, the detection device 27 comprises a CCD- or CMOS-image sensor 29, a sensory optic arranged in front of it and/or an optical image system with a shutter 49, a lens 51, and a partially mirrored prism 53. Furthermore, the detection device 27 comprises a light source 55, e.g., a LED, for lighting the article to be sewn 3 in the detection area of the image sensor 29. The LED, the image sensor 29 and an evaluating electronic 57, arranged adjacent thereto or integrated therein, is arranged on a common detection circuit board 59, which is electrically connected to the contact module, e.g. via a flexible circuit board 61 or a connection cable. In FIG. 4, a section through the sewing foot 23 of FIG. 2 is shown in a side view. The sensory optic images a sufficiently large area of the material surface on the image sensor 29, so that even relatively high speeds of the article to be sewn 3 in the range of e.g., 0.2 n/s to 0.6 m/s and relatively high accelerations of e.g., 5 $m/s^2$ can be detected.

In order to better understand the path of the light rays emitted by the LED, it is shown in a dashed line L1. Originating from the LED, the light passes a convex lens 63, which may be a component of the prism 53. The light beam L1 passes through the prism 53, which has a y-shape, and impinges the exit surface 53*a* of the prism 53, positioned at the bottom, at a first angle $\alpha$1, which is formed flush or slightly off-set in reference to the support surface of the sole 47 positioned at the bottom. The light beam L1 exits the prism at a second angle $\alpha$2 in reference to the exiting surface 53*a* and impinges the article to be sewn 3 at a second angle $\alpha$2, where it is partially reflected by the article to be sewn 3. Due to the fact that the refractive index of the prism 53 is higher than that of the environmental medium air, the second angle $\alpha$2 is smaller than the first angle $\alpha$1. The prism 53 and the light source 55 are preferably provided and arranged such that the impingement angle $\alpha$2 of the light beam to the article to be sewn 3 ranges from approximately 15° to approximately 45° and amounts approximately to 32°. The impingement angle $\alpha$2 is optimized such that, on the one hand, it is sufficiently low to ensure a high-contrast lighting of the article to be sewn 3 and, on the other hand, sufficiently high that at an increasing distance of the impingement surface 53*a* sufficient lighting of the detection area below the exiting surface 53*a* is still ensured within certain limits.

In FIG. 4, the light path is shown schematically in form of a dashed line L2 in a section of the surface of the article to be sewn 3 (detection area) below the exit surface 53*a*. The light path extends, originating from the article to be sewn 3, at a third angle $\alpha$3 amounting approximately to 90° through the exit surface 53*a*, which in this case is also the entry surface. At a mirrored reflection surface 53*b* of the prism 53, which is aligned approximately parallel to the light path L1 within the prism 53, the light is reflected on the light path L2 towards the image sensor 29. Here, the light paths L1 and L2 of the emitted and reflected light intersect. Prior to impinging the image sensor 29 the reflecting light L2 passes the sensory optic. In the previously described embodiment and arrangement of the detection device 27 the light source 55, the image sensor 29, and the evaluating electronic 57 can be located in a space-saving manner in close proximity to a common detection circuit board 59. The detection device 27 can be pre-fabricated in a cost-effective manner and can easily be connected to the sewing foot 23 without any adjustment, e.g. by a clip or a screw connection. The detection area can be arranged in the proximity of the stitching site of the sewing needle 19 so that deviations from the actual relative movement of the material or article to be sewn directly at the stitching site from the detected relative material movement are minimal. Here, the influence of disturbing rotary motions of the article to be sewn 3 around a rotary axis (not shown) extending through the stitching site is influential, in particular. The exiting surface 53*a* of the prism 53 is also the entry surface for imaging the detection area of the image sensor 29. It is relatively small and is immediately adjacent to the sole 47. The sewing foot 23 according to the invention therefore represents hardly any hindrance during sewing or quilting. The detection device 27 can be placed in close proximity of the article to be sewn 3. Therefore, the possibility for foreign objects to enter the detection area and influencing the measuring result is low.

Figure 5A:
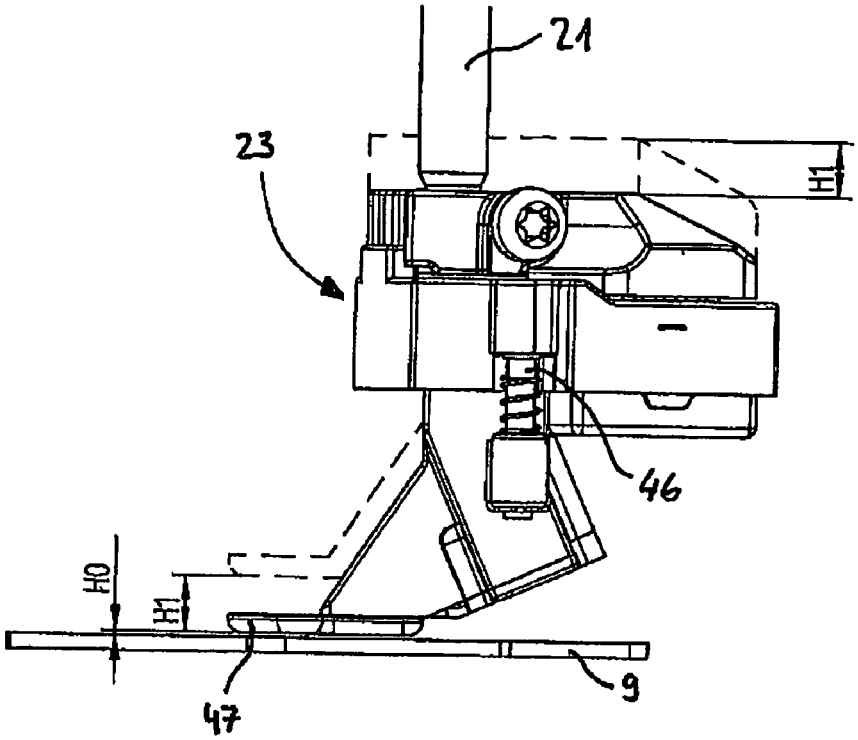
FIG. 5*a* is a side view of a sewing foot in the lowermost position of the jumping movement, without any material resting on the stitching plate.
Figure 5B:
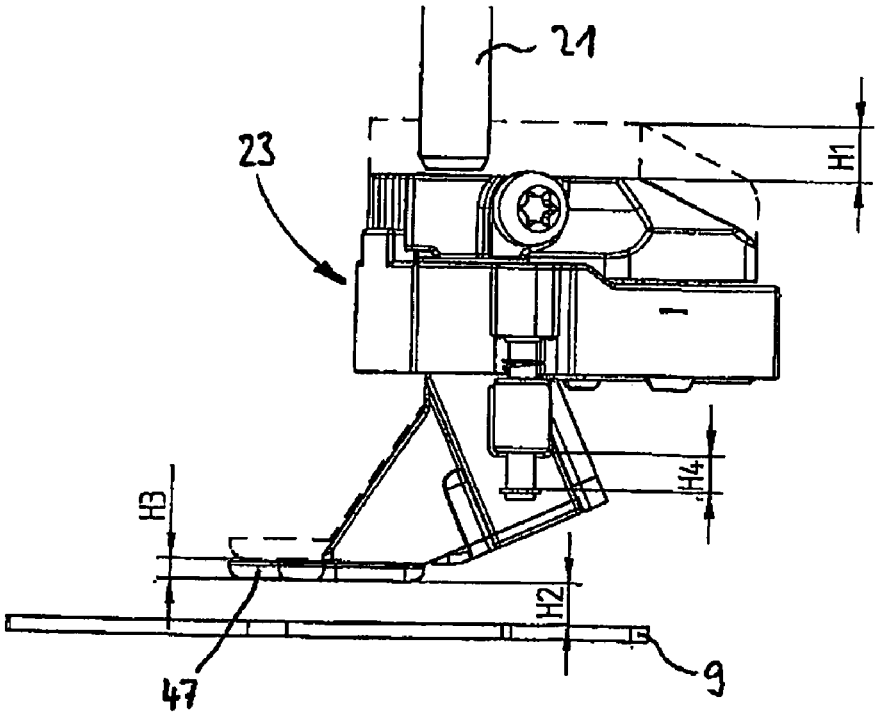
FIG. 5*b* is a view of the sewing foot according to FIG. 5*a* in a maximally lowered position having a thick stack of material resting on the stitching plate.
Figure 7:
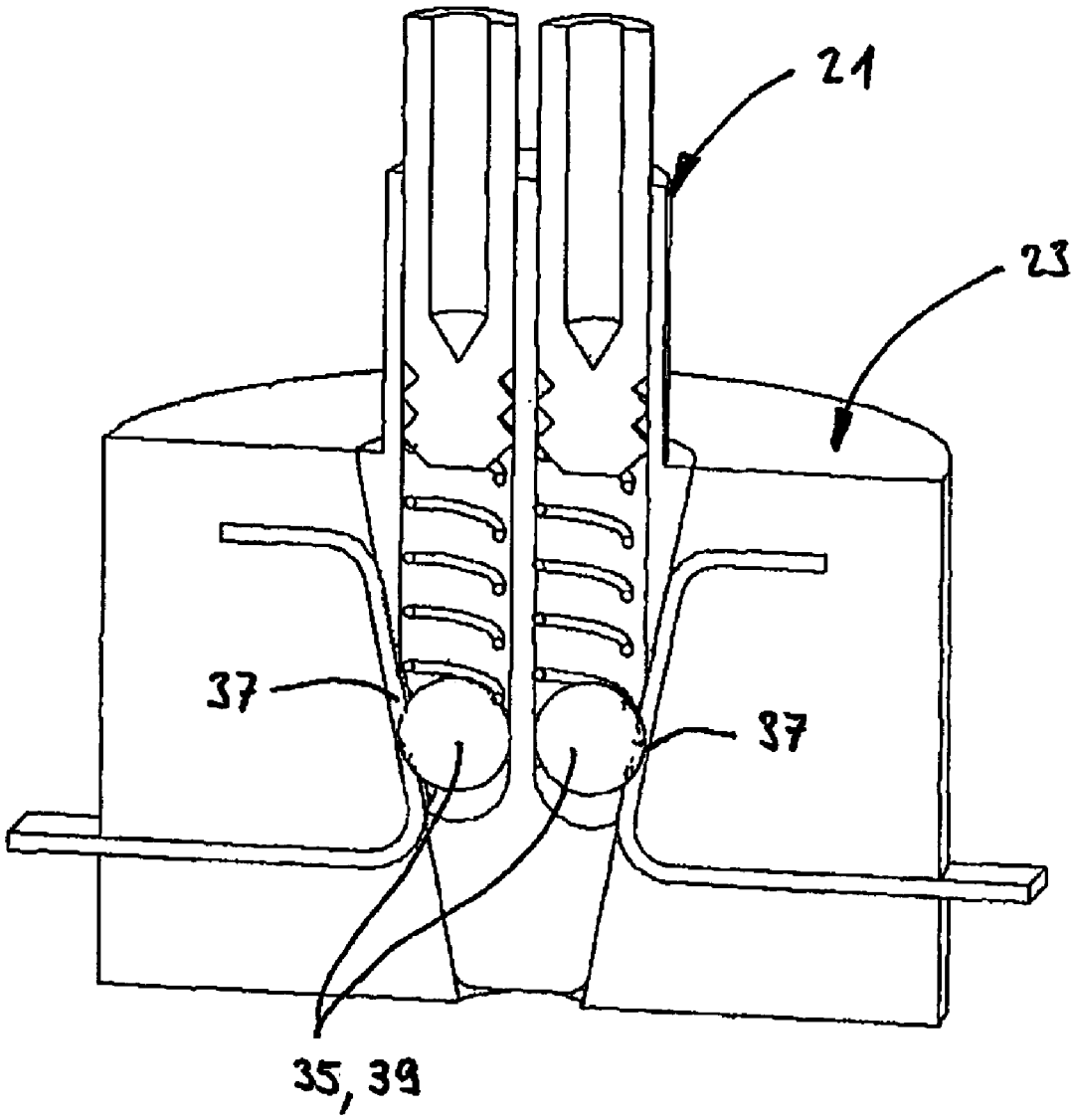
FIG. 7 is a sectional view of the contact site of the material pressure rod to the sewing foot.

The sensory optic or generally the detection device is provided such that a high resolution can be achieved compared to conventional optical mice. This is necessary because during quilting the material pressure rod 21 and the sewing foot 23 perform jumping motions in the rhythm of the stitch formation with a stroke H1 amounting to approximately 2.2 mm or 2.5 mm. Generally the distance H0 between the bottom of the sole 47 and the surface of the stitching plate 9 amounts to approximately 0.5 mm at the lowest position of the stroke at a free stitching plate 9. Therefore the entire stroke H1 can be utilized in the jumping motion of the sewing foot 23. Depending on the thickness H2 of the article to be sewn 3 and/or the stack of materials, the amplitude of the stroke H3 of the sewing foot 23 can be reduced and/or modified when the sole 47 of the sewing foot 23 is pending during the lowering of the article to be sewn 3. Although the material pressure rod 21 performs an entire stroke H1, the elastically supported intermediate part 43 of the sewing foot 23 is displaced against the force of helical springs 45 in reference to the shaft 31 by the amount H4=H2−H0. The jumping amplitude H3 of the sewing sole 47 to the article to be sewn 3 amounts to H3=H1+H0−H2. This fact is illustrated in the FIGS. 5*a* and 5*b*. Depending on the embodiment of the sewing machine 1, the distance H0 and/or the position of the material pressure rod 21 can be adjustable or interchangeable. Additionally, the stroke H1 can be constant or alternatively adjustable.

The optic of the detection device 27 is provided such that the sharpness, i.e. the area in which a reliable and/or sharp image on the image sensor 29 is possible in spite of jumping movements of the detection device 27, is greater than the maximum possible stroke H1 of the material pressure rod 21.

Alternatively the detection device 27 can also be mounted and/or embodied elastically at the material pressure rod 21 or the sewing foot 23 or at an arbitrary machine part above the stitching plate 9 in such a manner that it is pressed onto the article to be sewn 3 with a slight pressure (not shown). However, this would be disadvantageous in that it could hinder the displacement of the article to be sewn 3.

In another alternative embodiment of the invention, only a part of the detection device 27 is integrated in the sewing foot 23 or connected thereto, for example optical elements such as the prism 53 and/or lenses and/or mirrors and/or light conductors, the light source 55, and/or the image sensor 29 (not shown). In particular, elements such as the light source 55 and/or the image sensor 29, requiring an electric energy supply, can be arranged in the head part 15 or in the upper arm 13 of the sewing machine 1 and optical elements of the detection device 27 in the intermediate space between the head part 15 and the stitching plate 9.

Figure 6:
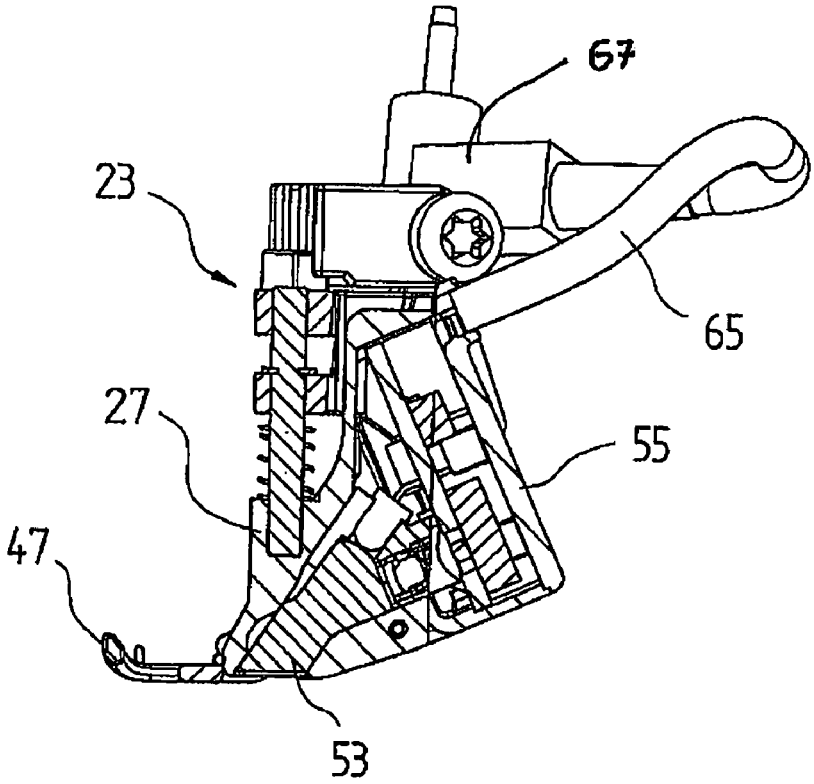
FIG. 6 is a side view, partially in cross-section, of another embodiment of a sewing foot.

FIG. 6 shows another embodiment of a sewing foot 23, in which the electric connection of the detection device 27 integrated in the sewing foot 23 and the machine control 25 arranged in the upper arm 13 occurs via a cable 65 with a plug connection, for example a multi-pole jack 67 and a complementary socket (not shown). Of course, alternatively any types of connections can be used between the detection device 27 and/or parts therefrom and the machine control 25. For example, electric and/or optic connection elements can be integrated and/or embodied directly at said material pressure rod 21. The feeding of the detection device 27 at the sewing foot 23 could occur via accumulators or batteries or alternatively via inductive energy transfer (not shown.)

The signal and/or information transfer between the detection device 27 and the machine control 25 could also occur via optic transmitters and receivers or via a radio transmission, for example Bluetooth® technology.

FIG. 6 shows a cross-section of the contact site between the material pressure rod 21 and the sewing foot 23 in a particular embodiment of the invention, in which spring-loaded contact surfaces 39 are embodied in the form of balls 35 at the material pressure rod 21. In a connected sewing foot 23, they contact the contact surfaces 37 embodied at the sewing foot 23.

In another advantageous embodiment of the invention, the sewing foot 23 may include means for imaging the stitching position of the sewing needle 19 at the material surface, for example in the form of a LED or laser diode with optic elements, which project a light spot and/or a limited light dot onto the stitching site at the material surface. Here, for example, electronically adjustable shutters or mobile mechanical elements can be provided, which compensate deviations of the light spot on the article to be sewn from the target position caused by jumping motions of the sewing foot 23.

In the following, the method according to the invention for controlling the up-and-down motion of the sewing needle 19 is described depending on the relative movement of the article to be sewn. The desired stitch length, i.e. the distance between two subsequent sewing stitches, is predetermined by the sewing machine control 25 via a user interface. After the activation of the device for controlling the movement of the needle, this can occur for example using the operating elements of the sewing machine 1 controlled by the machine control 25, the evaluation electronic 57 sets the coordinates x and y, which reflect the position of the article to be sewn 3, to a reference value, e.g., (x,y)=(0.0). Subsequently, relative changes of position and/or movements of the article to be sewn 3 are detected by the detection device 27. For this purpose, the detection device 27 evaluates the information provided by the image sensor 29 with a high clock speed of, e.g., 1500 pictures per second and determines, for example, the relative change of the position coordinates x and y in subsequent pictures and updates the position coordinates according to the actual position of the article to be sewn 3.

Alternatively or additionally other parameters, such as the rotary point and/or the rotary angle and/or the rotary radius can be determined in a rotational movement of the article to be sewn 3. In particular, the evaluation electronic 57 can be embodied such that rotary motions of the article to be sewn 3 around a rotary axis (not shown) extending through the stitching site of the sewing needle 19, or portions of such a rotary motion in reference to the relative movement of the article to be sewn 3 can be filtered out and be excluded from consideration for the calculation of the next stitching site. Of course, additional detection devices 27 can be provided, by which the movement of the article to be sewn can be detected at different points. As soon as the distance between the actual position of the article to be sewn 3 and the reference value (0,0) is equivalent to the adjusted stitch length the detection device 27 of the machine control 25 gives the order to execute a sewing stitch. Of course the stitch formation can alternatively initiated already shortly before reaching the preset stitch length, in order to compensate the relative drive of the article to be sewn 3 in the time between the stitch initiation and the needle 19 stitching into the article to be sewn 3. Simultaneously and/or immediately prior and after the order to initiate the stitch, the coordinates x and y reflecting the position of the article to be sewn 3 are reset to the reference value. In order to execute individual sewing stitches the upper camshaft, driving the needle 19, and/or the primary motor for executing the acceleration and subsequent braking of the sewing stitches with full force as soon as a sewing stitch is executed with a stay of the sewing needle 19 in the article to be sewn 3 being as short as possible and the sewing needle 19 subsequently again being parked in the upper resting position ready for the next sewing stitch. This type of operation is particularly suitable for slow feeds of the article to be sewn 3.

Alternatively the primary motor can also operate with a minimum idling speed of, for example 500 or 800 rotations per minute, as soon as it is activated by the treadle starter, for example. In this case the needle rod 17 can be decoupled from the primary drive via a coupling device (not shown) and be parked in the upper resting position decoupled from the primary drive, for example. When the material feed is equivalent to the predetermined stitch length, the needle rod is temporarily coupled to the primary drive for executing a sewing stitch and subsequently again decoupled. This type of operation is suitable for slow to medium speeds of material feed, thus for example at the beginning of the movement of the article to be sewn 3 and prevents the frequent change between full drive speed and/or full acceleration and full braking of the movement of the needle rod.

Both of the above-mentioned types of operation can prevent the sewing needle 19 from being deflected by the movement of the article to be sewn. This could result in the sewing needle 19 impinging the stitching plate 9, damaging the sewing needle 19 and/or the sewing machine 1.

For medium and high speeds of material feed the method can be refined as follows: The machine control 25 informs the detection device 27 regarding the respective position and speed of the sewing needle 19. Depending on the feeding speed of the article to be sewn 3 the evaluation electronic 57 calculates the optimum target speed and /or target deceleration for the sewing needle 19 and forwards it to the machine control 25. This way the machine control 25 is not subjected to unnecessary calculation tasks. Additionally for calculating the target value an optimally adjusted fast microcontroller can be used for the task. For fast material feeds, the sewing needle 19 is no longer entirely braked between the individual sewing stitches but performs a continuously progressing motion. Here it is ensured that the duration of the stay of the sewing needle 19 in the article to be sewn 3 is sufficiently short so that a reliable stitch formation can be performed. Of course, the processing of the measurement sizes of the image sensor 29 can also be partially or entirely performed by the machine control 25 when it is provided with sufficient processing capacity. The limits between the evaluation electronics 57 and the machine control 25 are therefore not definitely predetermined. In particular, the machine control 25 can include the evaluation electronics 57.

One or more reference values can be predetermined in a storage device (not shown). When the rotation of the needle drive or an appropriate measurement value exceeds or falls short of such a reference value a change between the above-described different operational modes can be initiated. Of course, a direction-dependent hysteresis is provided here, in order to prevent an undefined change of the individual operational modes. The detection device described and/or parts therefrom can also be used for other purposes, of course, for example for influencing the transport device 7 for the article to be sewn 3 or for detecting the features of the article to be sewn 3 prior or after its processing. Some examples of such features are the material structure, the position of the edges of the article to be sewn, or the quality of the seams.

Instead of or in addition to a direct connection of the detection device 27 to the machine control 25, for example, it can be provided with a plug connection to the socket of the treadle starter 69. In particular, sewing machines 1 can be provided with or retrofitted with the pressure feet 23 according to the invention without any additional measures. The evaluation electronics 57 of the detection devices 27 include an address control in such pressure feet 23, which can simulate the effect of treadle starters. In a particularly advantageous variant of the invention, as shown in FIG. 1, an adapter 73 is provided, which can be inserted directly into the socket 71 for the treadle starter 69 and includes one coupling 75 each for connecting the treadle starter 69 and the connection plug 67 to the sewing foot 23. The adapter 73 includes the simulation electronic for influencing the movement of the sewing needle depending on the signals of the evaluation electronic 57 and the operation of the treadle starter 69. The treadle starter 69 serves as a safety or primary switch for operating the sewing machine 1. The needle drive can only be activated with an activated treadle starter 69. In conventional sewing machines 1, the machine control 25 reacts sluggishly and/or with a delay to the adjustment value of the treadle starter 69 for safety reasons. The machine control 25 can now be adjusted by a change in hardware, for example by adjusting a low-pass filter and/or by adjusting the evaluation software such that it can influence the needle drive without delay when the detection device 27 is effectively connected to the machine control 25 via the connection site for the treadle starter 69. A delay-free influence of the article to be sewn is therefore possible independent from the effective connection of the detection device 27 to the machine control 25 occurring via a direct electric connection, a wireless optic one, or a radio connection or via a treadle starter connection.

LEGEND OF THE REFERENCE CHARACTERS

1 sewing machine
3 article to be sewn
5 lower arm
7 transportation device
**7*a*** transporter
9 stitching plate
11 stand
13 upper arm
15 head part
17 needle rod
19 sewing needle
21 material pressure rod
23 sewing foot
25 machine control
27 detection device
29 image sensor
31 shaft
33 accepting opening
35 balls
37 contact element
39 contact surface
41 contact circuit board
43 intermediate part
45 helical spring
46 guiding rod
47 sole
48 stop
49 shutter
51 lens
53 prism

53*a* exit surface
55 light source
57 evaluation electronics
59 detection print
61 flex circuit board
63 convex lens
67 cable
67 plug

The invention claimed is:

1. A method for controlling the movement of a needle in a sewing machine (1), provided with a detection device (27) for detecting relative movements of an article to be sewn (3) resting on a material support in reference to the sewing machine (1), comprising:

providing an optical detection device that detects a top surface of the article to be sewn facing the sewing needle (19);

using processing electronics for determining a movement of the article based on optical features contained within the top surface detected by the detection device and generating needle movement signals;

controlling movement of the needle with a controller solely depending on the needle movement signals based on the actual movement of the top surface of the material facing the sewing needle (19).

2. A method according to claim 1, wherein the detection device (27) detects movements of the material surface in an area of the stitching site of the sewing needle (19).

3. A method according to one of claims 1, further comprising imaging a part of the material surface detectable by the detection device (27) via optical elements (49, 51, 53, 63) on an image sensor (29), and processing the information from the image sensor (29) to establish control values for the movement of the sewing needle.

4. A method according to claim 3, further comprising guiding light from a light source (55) via the optical elements (53, 63) onto the material surface such that a surface structure of the material surface is high-contrast detectable by the detection device (27).

5. A method according to claim 1, further comprising controlling a needle drive for the needle depending on the detected movements of the article to be sewn such that distances between adjacent sewing stitches are equivalent to a predetermined value.

6. A method according to claim 5, further comprising the detection device (27) communicating with a machine control (25) to transmit target values for controlling the movement of the needle to the machine control (25).

7. A method according to claim 1, further comprising influencing the movement of the sewing needle (19) via a treadle starter or a control member connectable to the sewing machine (1).

8. A method according to claim 1, wherein the controlling of the movement of the needle occurs without any delay depending on signals of the detection device (27).

9. The method according to claim 1, further comprising providing a sewing foot (23) with optic elements for a sectional detection or imaging of the material surface.

10. The method according to claim 9, further comprising providing the sewing foot (23) with a connection to the machine control (25) or to an adapter that can be connected to an interface for a treadle starter.

11. The method according to claim 9, further comprising providing the sewing foot (23) with means for imaging stitching positions of the sewing needle (19) at the material surface.

12. The method according to claim 9, further comprising connecting a treadle starter to a socket in the sewing machine using an adapter.

13. A device for controlling movement of a needle in a sewing machine (1), comprising an optical detection device (27) that detects relative movements of a top surface of an article to be sewn (3) resting on a material support of the sewing machine (1), processing electronics that determine the movement of the article based on optical features within the top surface detected by the detection device and which generates needle movement signals, and a controller that receives the needle movement signals and is adapted to solely control the movement of the needle depending on the needle movement signals based on the movements of the top surface of the article to be sewn.

14. A device according to claim 13, wherein at least a part of the detection device (27) is provided in such a manner that vertical movements can be executed for an adjustment to a topography of the article to be sewn (3).

15. A device according to claim 13, wherein the detection device (27) is integrated partially or entirely in a sewing foot (23).

16. A device according to claim 13, wherein the detection device (27) includes an image sensor (29) and a display optic, with a section of the material surface adapted to be positioned in a detection area of the detection device (27) to be imaged by the display optic on the image sensor (29).

17. A device according to claim 13, wherein the detection device includes a light-emitting diode, photodiode or infared laser sensor.

* * * * *